US006837226B2

(12) United States Patent
Wang et al.

(10) Patent No.: US 6,837,226 B2
(45) Date of Patent: Jan. 4, 2005

(54) SYSTEM FOR DIAGNOSING EGR VALVE, ACTUATOR AND SENSOR RELATED FAILURE CONDITIONS

(75) Inventors: Yue Yun Wang, Columbus, IN (US); Xiaoqui Li, Columbus, IN (US); Mark R. Stepper, Columbus, IN (US); Chang Yang, West Bloomfield, MI (US)

(73) Assignee: Cummins, Inc., Columbus, IN (US)

( * ) Notice: Subject to any disclaimer, the term of this patent is extended or adjusted under 35 U.S.C. 154(b) by 0 days.

(21) Appl. No.: 09/774,524

(22) Filed: Jan. 31, 2001

(65) Prior Publication Data

US 2002/0129799 A1 Sep. 19, 2002

(51) Int. Cl.[7] ..... F02M 25/07; F02B 47/08

(52) U.S. Cl. ..... 123/568.16

(58) Field of Search ..... 123/568.11–568.28

(56) References Cited

U.S. PATENT DOCUMENTS

| | | | | |
|---|---|---|---|---|
| 4,409,948 A | | 10/1983 | Hasegawa et al. | |
| 4,548,185 A | * | 10/1985 | Pozniak | 123/568.27 |
| 4,665,882 A | | 5/1987 | Otobe | |
| 4,881,509 A | | 11/1989 | Ohashi et al. | |
| 4,947,820 A | | 8/1990 | Kushi | |
| 4,969,104 A | | 11/1990 | Suzuki et al. | |
| 5,014,203 A | | 5/1991 | Miyazaki et al. | |
| 5,150,696 A | | 9/1992 | Kabasin et al. | |
| 5,190,017 A | | 3/1993 | Cullen et al. | |
| 5,257,610 A | | 11/1993 | Ohuchi | |
| 5,273,019 A | | 12/1993 | Matthews et al. | |
| 5,297,047 A | | 3/1994 | Matsuno | |
| 5,341,300 A | | 8/1994 | Fujimoto | |
| 5,383,126 A | | 1/1995 | Ogawa et al. | |
| 5,505,174 A | | 4/1996 | Komoriya et al. | |
| 5,508,926 A | | 4/1996 | Wade | |
| 5,639,961 A | | 6/1997 | Lautenschutz | |
| 5,675,080 A | | 10/1997 | Wada | |
| 5,703,285 A | | 12/1997 | Shimizu et al. | |
| 5,845,627 A | | 12/1998 | Olin et al. | |
| 5,934,249 A | | 8/1999 | Nanba et al. | |
| 5,964,820 A | | 10/1999 | Miwa et al. | |
| 5,970,961 A | * | 10/1999 | Kotwicki et al. | 123/568.27 |
| 6,035,835 A | | 3/2000 | Shigihama et al. | |
| 6,085,732 A | | 7/2000 | Wang et al. | |
| 6,142,117 A | * | 11/2000 | Hori et al. | 123/295 |

* cited by examiner

*Primary Examiner*—Paul J. Hirsch
(74) *Attorney, Agent, or Firm*—Barnes & Thornburg

(57) ABSTRACT

An EGR fault/failure determination system for an internal combustion engine is operable to monitor a number of EGR system operational parameters and diagnose various EGR-related fault and failure statuses therefrom. For example, the system is operable to determine a number of EGR system-related fault and failure conditions by monitoring measured and command EGR position signals to determine EGR valve controller functionality, to monitor response times between fully open and closed EGR valve positions by comparing measured response times to a calibratable response time value, and to monitor in-range EGR position failures associated with fully closed and fully opened EGR valve position values. The system further includes a Kalman filter-based fault/failure isolation feature operable to isolate and identify one or more sources of EGR valve-related faults/failures.

11 Claims, 7 Drawing Sheets

SYSTEM FOR DIAGNOSING EGR VALVE, ACTUATOR AND SENSOR RELATED FAILURE CONDITIONS

FIELD OF THE INVENTION

The present invention relates generally to diagnostic systems for internal combustion engines, and more specifically to systems for diagnosing fault and failure conditions relating to EGR valves, EGR valve actuators and EGR valve position sensors.

BACKGROUND OF THE INVENTION

When combustion occurs in an environment with excess oxygen, peak combustion temperatures increase which leads to the formation of unwanted emissions, such as oxides of nitrogen ($NO_x$). One known technique for reducing unwanted emissions such as $NO_x$ involves introducing chemically inert gases into the fresh air flow stream for subsequent combustion. By thusly reducing the oxygen concentration of the resulting charge to be combusted, the fuel burns slower and peak combustion temperatures are accordingly reduced, thereby lowering the production of $NO_x$.

In an internal combustion engine environment, such chemically inert gases are readily abundant in the form of exhaust gases, and one known method for achieving the foregoing result is through the use of a so-called Exhaust Gas Recirculation (EGR) system operable to controllably introduce (i.e., recirculate) exhaust gas from the exhaust manifold into the fresh air stream flowing to the intake manifold.

EGR operation is typically not required under all engine operating conditions, and known EGR systems accordingly include a valve, commonly referred to as an EGR valve, for controllably introducing exhaust gas to the intake manifold. Through the use of an on-board microprocessor, control of the EGR valve is typically accomplished as a function of information supplied by a number of engine operational sensors.

It is important to monitor the functionality of EGR valve control mechanisms for faults or failures that may occur during operation thereof. For example, if an EGR valve position sensor fails due to valve sticking, in-range, out-of-range or related failure conditions, it is desirable to monitor such conditions and log appropriate faults when they occur. Moreover, it is further important to distinguish failure conditions associated with an EGR position sensor from those associated with an EGR valve actuator, and to distinguish failure conditions associated with either of these mechanisms from those associated with an EGR valve actuator control system. What is therefore needed is a system for diagnosing certain fault conditions associated with an EGR valve position sensor, and for further isolating which of the one or more EGR valve position control system components are responsible for detected failure conditions.

SUMMARY OF THE INVENTION

The foregoing shortcomings of the prior art are addressed by the present invention. In accordance with one aspect of the present invention, a system for diagnosing EGR valve-related failure conditions comprises an EGR valve having a valve inlet in fluid communications with an exhaust manifold of an internal combustion engine and a valve outlet in fluid communications with an intake manifold of the engine, the EGR valve responsive to a valve command to control exhaust gas flow therethrough, an EGR position sensor producing an EGR valve position signal indicative of EGR valve position, and an engine controller producing the valve command, the engine controller responsive to the EGR valve position signal and the valve command to determine when the valve command corresponds to commanding the EGR valve from one of a fully closed and a fully open position thereof to one of a fully open and a fully closed position thereof, the controller thereafter responsive to the valve position signal to measure a response time between the one of a fully closed and a fully open position and the one of a fully open and fully closed position, the engine controller logging an EGR valve response time fault if the response time is greater than a response time limit.

In accordance with another aspect of the present invention, a system for diagnosing EGR valve-related failure conditions comprises an EGR valve having a valve inlet in fluid communications with an exhaust manifold of an internal combustion engine and a valve outlet in fluid communications with an intake manifold of the engine, the EGR valve responsive to a valve command to control exhaust gas flow therethrough, means for determining a position of the EGR valve and producing an EGR valve position signal corresponding thereto, and an engine controller producing the valve command, the engine controller responsive to the EGR valve position signal and the valve command to determine when the valve command corresponds to commanding the EGR valve from one of a fully closed and a fully open position thereof to one of a fully open and a fully closed position thereof, the controller thereafter responsive to the valve position signal to determine a final valve position after a time delay following the valve command, the engine controller logging an EGR valve response time fault if a difference between the final valve position and an expected valve position is greater than a position threshold.

In accordance with yet another aspect of the present invention, a system for diagnosing EGR valve control system related failure conditions comprises an EGR valve having a valve inlet in fluid communications with an exhaust manifold of an internal combustion engine and a valve outlet in fluid communications with an intake manifold of the engine, an actuator responsive to a drive signal to control a position of the EGR valve, a position sensor producing a position signal indicative of actuator position, a current sensor producing a current signal indicative of actuator current, a valve controller responsive to an error signal corresponding to a difference between a valve command and the position signal to produce the drive signal, and an engine controller responsive to the valve command and the position signal to produce a position estimate, and to the valve command and the current signal to produce a current estimate, the engine controller diagnosing a properly functioning EGR valve control system if the error signal is less than a first threshold, a difference between the position signal and the position estimate is less than a second threshold and a difference between the current signal and the current estimate is less than a third threshold.

In accordance with a further aspect of the present invention, a system for diagnosing EGR valve control system related failure conditions comprises an EGR valve having a valve inlet in fluid communications with an exhaust manifold of an internal combustion engine and a valve outlet in fluid communications with an intake manifold of the engine, an actuator responsive to a drive signal to control a position of the EGR valve, a position sensor producing a position signal indicative of actuator position, a current sensor producing a current signal indicative of actuator current, a valve controller responsive to an error signal corresponding to a difference between a valve command and the position signal to produce the drive signal, and an engine controller responsive to the valve command and the position signal to produce a position estimate, and to the valve command and the current signal to produce a current estimate, the engine controller diagnosing a valve controller failure if the error signal is greater than a first threshold, a difference between the position signal and the position estimate is less than a second threshold and a difference between the current signal and the current estimate is less than a third threshold.

In accordance with yet a further aspect of the present invention, a system for diagnosing EGR valve control system related failure conditions comprises an EGR valve having a valve inlet in fluid communications with an exhaust manifold of an internal combustion engine and a valve outlet in fluid communications with an intake manifold of the engine, an actuator responsive to a drive signal to control a position of the EGR valve, a position sensor producing a position signal indicative of actuator position, a current sensor producing a current signal indicative of actuator current, a valve controller responsive to an error signal corresponding to a difference between a valve command and the position signal to produce the drive signal, and an engine controller responsive to the valve command and the position signal to produce a position estimate, and to the valve command and the current signal to produce a current estimate, the engine controller diagnosing a position sensor failure if the error signal is greater than a first threshold, a difference between the position signal and the position estimate is greater than a second threshold and a difference between the current signal and the current estimate is less than a third threshold.

In accordance with still a further aspect of the present invention, a system for diagnosing EGR valve control system related failure conditions comprising, an EGR valve having a valve inlet in fluid communications with an exhaust manifold of an internal combustion engine and a valve outlet in fluid communications with an intake manifold of the engine, an actuator responsive to a drive signal to control a position of the EGR valve, a position sensor producing a position signal indicative of actuator position, a current sensor producing a current signal indicative of actuator current, a valve controller responsive to an error signal corresponding to a difference between a valve command and the position signal to produce the drive signal, and an engine controller responsive to the valve command and the position signal to produce a position estimate, and to the valve command and the current signal to produce a current estimate, the engine controller diagnosing a current sensor failure if the error signal is less than a first threshold, a difference between the position signal and the position estimate is less than a second threshold and a difference between the current signal and the current estimate is greater than a third threshold.

In accordance with still another aspect of the present invention, a system for diagnosing EGR valve control system related failure conditions comprises an EGR valve having a valve inlet in fluid communications with an exhaust manifold of an internal combustion engine and a valve outlet in fluid communications with an intake manifold of the engine, an actuator responsive to a drive signal to control a position of the EGR valve, a position sensor producing a position signal indicative of actuator position, a current sensor producing a current signal indicative of actuator current, a valve controller responsive to an error signal corresponding to a difference between a valve command and the position signal to produce the drive signal, and an engine controller responsive to the valve command and the position signal to produce a position estimate, and to the valve command and the current signal to produce a current estimate, the engine controller diagnosing an actuator failure if the error signal is greater than a first threshold, a difference between the position signal and the position estimate is greater than a second threshold and a difference between the current signal and the current estimate is greater than a third threshold.

One object of the present invention is to provide a system for diagnosing EGR valve control system related failures.

Another object of the present invention is to provide such a system operable to diagnose in-range and out-of-range EGR valve position sensor failures.

Yet another object of the present invention is to provide an EGR valve control system failure diagnosis strategy operable to diagnose a number of different EGR valve control system failures based on differences between a valve command and a valve actuator position, between measured and estimated values of valve actuator position and between measured and estimated values of valve actuator current.

These and other objects of the present invention will become more apparent from the following description of the preferred embodiments.

DESCRIPTION OF THE PREFERRED EMBODIMENTS

Figure 1:
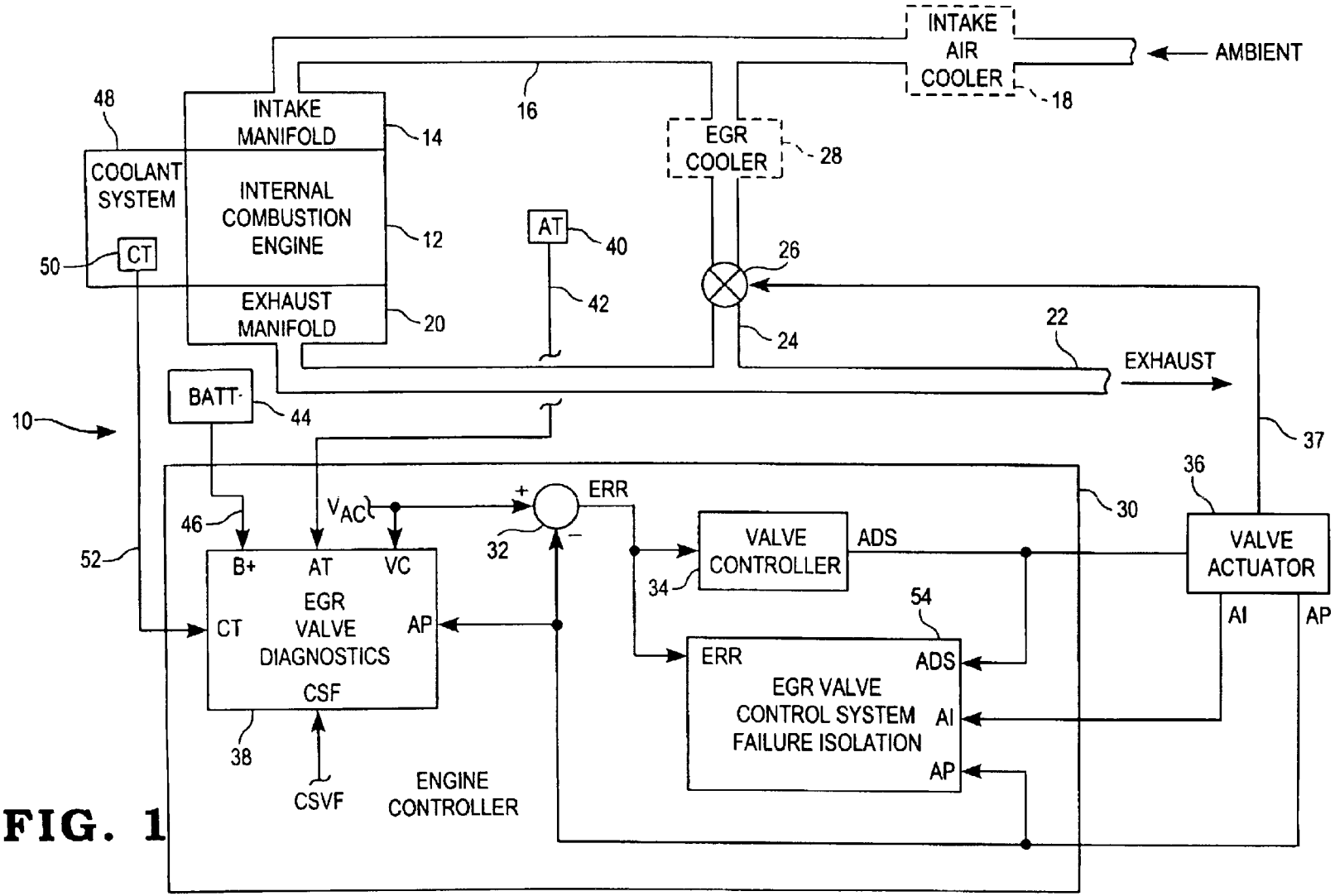
FIG. 1 is a diagrammatic illustration of one preferred embodiment of a system for diagnosing EGR valve, actuator and sensor related failures, in accordance with the present invention.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

Referring now to FIG. 1, one preferred embodiment of a system 10 for diagnosing EGR valve, actuator and sensor-related failures, in accordance with the present invention, is shown. System 10 includes an internal combustion 12 having an intake manifold 14 receiving fresh air via intake conduit 16. Optionally, as shown in phantom in FIG. 1, system 10 may include an intake air cooler 18 of known construction disposed in line with intake conduit 16. An exhaust manifold 20 expels engine exhaust to ambient via exhaust conduit 22, and an EGR conduit 24 is disposed in fluid communication with exhaust conduit 22 and intake conduit 16. An EGR valve 26 of known construction is disposed in line with EGR conduit 24, and an EGR cooler 28 of known construction may optionally be disposed between EGR valve 26 and intake conduit 16 as shown in phantom in FIG. 1.

System 10 includes an engine controller 30 that is preferably microprocessor-based and is generally operable to control and manage the overall operation of engine 12. Engine controller 30 includes a memory unit (not shown) as well as a number of inputs and outputs for interfacing with various sensors and systems coupled to engine 12. Controller 30, in one embodiment, may be a known control unit sometimes referred to as an electronic or engine control module (ECM), electronic or control unit (ECU) or the like, or may alternatively be a general control circuit capable of operation as described hereinafter.

Engine controller 30 preferably includes a summing node 32 having an addition input receiving a valve actuation command (VAC) and a subtraction input receiving an actuator position signal (AP) from a valve actuator circuit 36. Summing node 32 is operable to produce an error signal (ERR) as a difference between the valve actuation command (VAC) and the actuator position signal (AP). The error signal (ERR) is applied to an input of a valve controller block 34 operable to produce an actuator drive signal (ADS) as a function thereof. The valve actuator circuit 36 is responsive to the actuator drive signal (ADS) produced by valve controller block 34 to either electronically or mechanically control the position of the EGR valve 26 via signal path 37.

In accordance with one aspect of the present invention, engine controller 30 preferably includes an EGR valve diagnostics block 38 receiving a number of input signals from a corresponding number of sensors associated with engine 12. For example, system 10 includes an ambient temperature sensor 40 of known construction that is electrically connected to an ambient temperature input (AT) of EGR valve diagnostics block 38. Sensor 40 may be of known construction, and is operable to produce an ambient temperature signal on signal path 42 indicative of ambient temperature. System 10 further includes a coolant system 48 having a coolant temperature sensor 50 in fluid communication therewith and electrically connected to a coolant temperature input (CT) of EGR valve diagnostics block 38 via signal path 52. Sensor 50 may be of known construction and is operable to produce a coolant temperature signal on signal path 52 indicative of the operating temperature of engine 12.

System 10 further includes a battery 44 that is electrically connected to a battery input (B+) via signal path 46. EGR valve diagnostics block 38 further includes a charging system fault input (CSF) receiving a charging system voltage fault signal indicative of a fault state of a charging system sensor voltage supply. If a charging system sensor voltage supply fault is present, CSVF is preferably set at a first logic state, and is set to an opposite logic state if a charging system sensor voltage supply fault is not present. EGR valve diagnostics block 38 further includes a valve control input (VC) receiving the valve actuator command signal (VAC) thereat, and an actuator position input (AP) receiving the actuator position signal thereat.

In accordance with another aspect of the present invention, engine controller 30 further includes an EGR valve control system failure isolation block 54 having an error input (ERR) receiving the error signal (ERR) produced by summing node 32. Block 54 further includes an actuator drive signal input (ADS) receiving the actuator drive signal (ADS) produced by valve controller block 34, an actuator current input (AI) receiving an actuator operating current signal (AI) from the valve actuator circuit 36, and an actuator position input (AP) receiving the actuator position signal (AP) produced by valve actuator circuit 36.

Figure 2A:
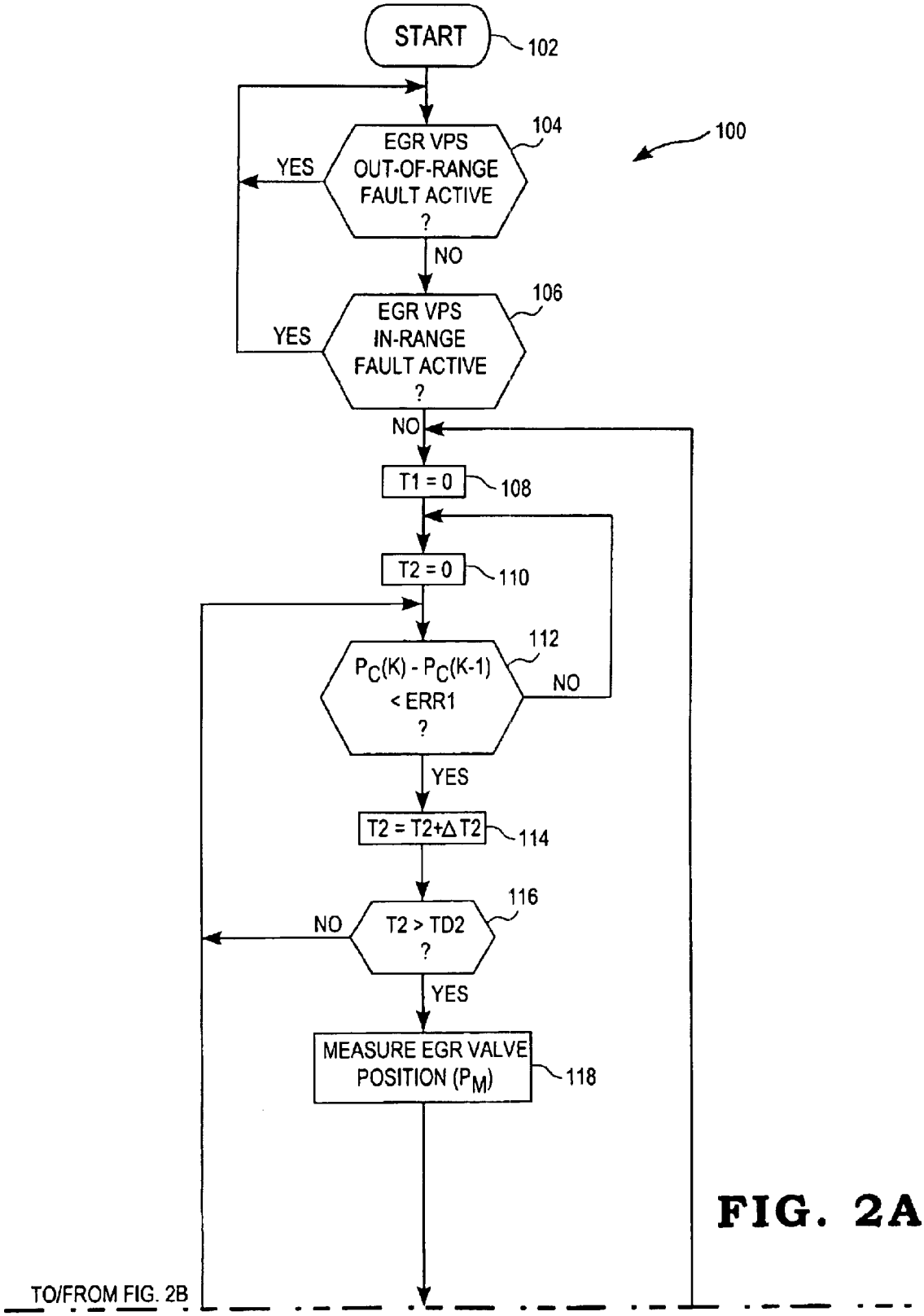
FIGS. 2A and 2B comprise a flowchart illustrating one preferred embodiment of a software algorithm for diagnosing EGR valve functionality, in accordance with the present invention.
Figure 2B:
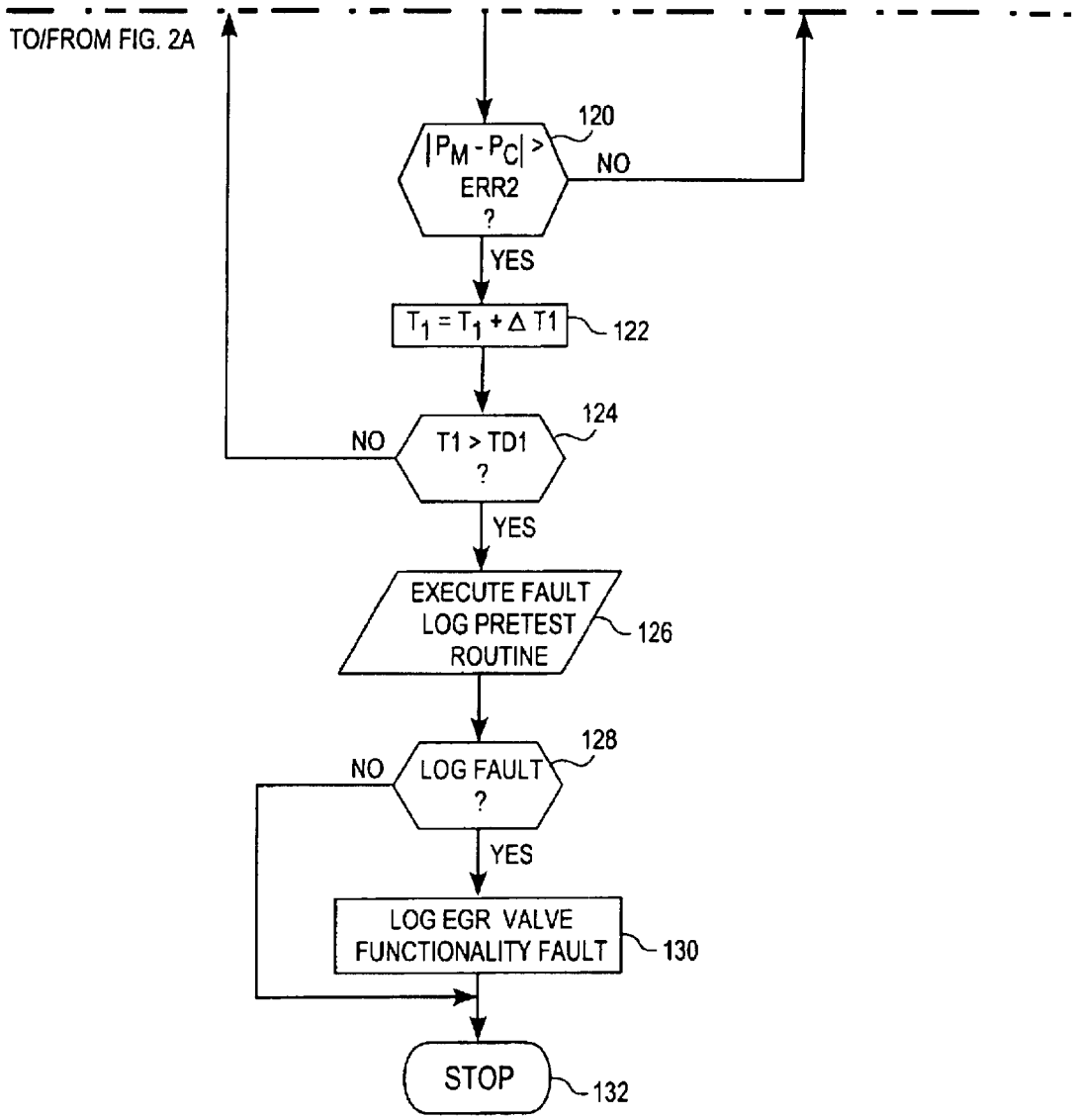

Referring now to FIGS. 2A and 2B, a flowchart 100 is shown illustrating one preferred embodiment of a software algorithm for diagnosing EGR valve functionality, in accordance with the present invention. Algorithm 100 is preferably stored within the EGR valve diagnostics block 38 of FIG. 1, and is executable by engine controller 30 as is known in the art. Algorithm 100 begins at step 102, and at step 104, controller 30 is operable to determine whether an internally generated EGR valve position sensor out-of-range fault is currently active. If so, algorithm execution loops back to step 104 until such time that the fault becomes inactive. If, at step 104, controller 30 determines that the EGR valve position sensor out-of-range fault is not active, algorithm 100 advances to step 106 where controller 30 is operable to determine whether an EGR valve position sensor in-range fault is currently active. If so, algorithm execution loops back to step 104. If controller 30 determines at step 106 that an EGR valve position sensor in-range fault is not currently active, algorithm execution advances to step 108 where a first timer T1 is set equal to zero. Thereafter, at step 110, a second timer T2 is also set to zero. It is to be understood that the timer values set at steps 108 and 110 are arbitrary, and may therefore take on values other than zero.

Following step 110, algorithm execution advances to step 112 where engine controller 30 is operable to determine a difference between a currently commanded valve position $P_C(K)$ and a previously commanded valve position $P_C(K-1)$. If this difference is greater than or equal to an error value ERR1, algorithm execution loops back to step 110 to reset the second timer T2. If, however, the EGR valve position command value difference at step 112 is less than ERR1, algorithm execution advances to step 114 where timer T2 is incremented by an amount ΔT2. Following step 114, controller 30 is operable at step 116 to compare the current value of timer T2 to a predefined delay time TD2. If controller 30 determines at step 116 that T2 has not exceeded TD2, algorithm execution loops back to step 112. If, however, controller 30 determines at step 116 that timer T2 has exceeded TD2, algorithm execution advances to step 118 where controller 30 is operable to measure the current EGR valve position $P_M$. Preferably, controller 30 is operable to execute step 118 by monitoring the actuator position signal (AP) produced by valve actuator circuit 36. Thereafter at step 120, controller 30 is operable to determine an absolute value of a difference between the measured valve position ($P_M$) determined at step 118 and the most recent valve position command $P_C$ from step 112, and compare this difference with a second error value ERR2. If controller 30 determines at step 120 that the difference between the measured and commanded valve position values is less than or equal to ERR2, algorithm execution loops back to step 108. If, on the other hand, controller 30 determines at step 120 that the difference between the measured and commanded valve position values is greater than ERR2, algorithm execution advances to step 122 where the timer T1 is incremented by an amount ΔT1. Thereafter at step 124, the value of the timer T1 is compared to a predefined timer delay period TD1. If controller 30 determines at step 124 that the value of timer T1 is less than or equal to TD1, algorithm execution loops back to step 112. If controller 30 determines that the value of timer T1 has exceeded TD1, algorithm execution advances to step 126.

At step 126, controller 30 is operable to execute a fault log pretest routine as will be described in greater detail hereinafter with respect to FIG. 4. From step 126, algorithm execution advances to step 128 where controller 30 is operable to determine, based on information provided by routine 126, whether a fault should be logged. If so, algorithm execution advances to step 130 where controller 30 is operable to log an EGR valve functionality fault. From step 130, or if controller 30 determined at step 128 that a fault was not to be logged, algorithm execution advances to step 132 where algorithm 100 stops.

Under steady state conditions, EGR valve lift should closely follow the commanded valve lift, and the control error (ERR) produced at the output of summing node 32 should be zero. Algorithm 100 is directed to making such a determination as just described.

Figure 3A:
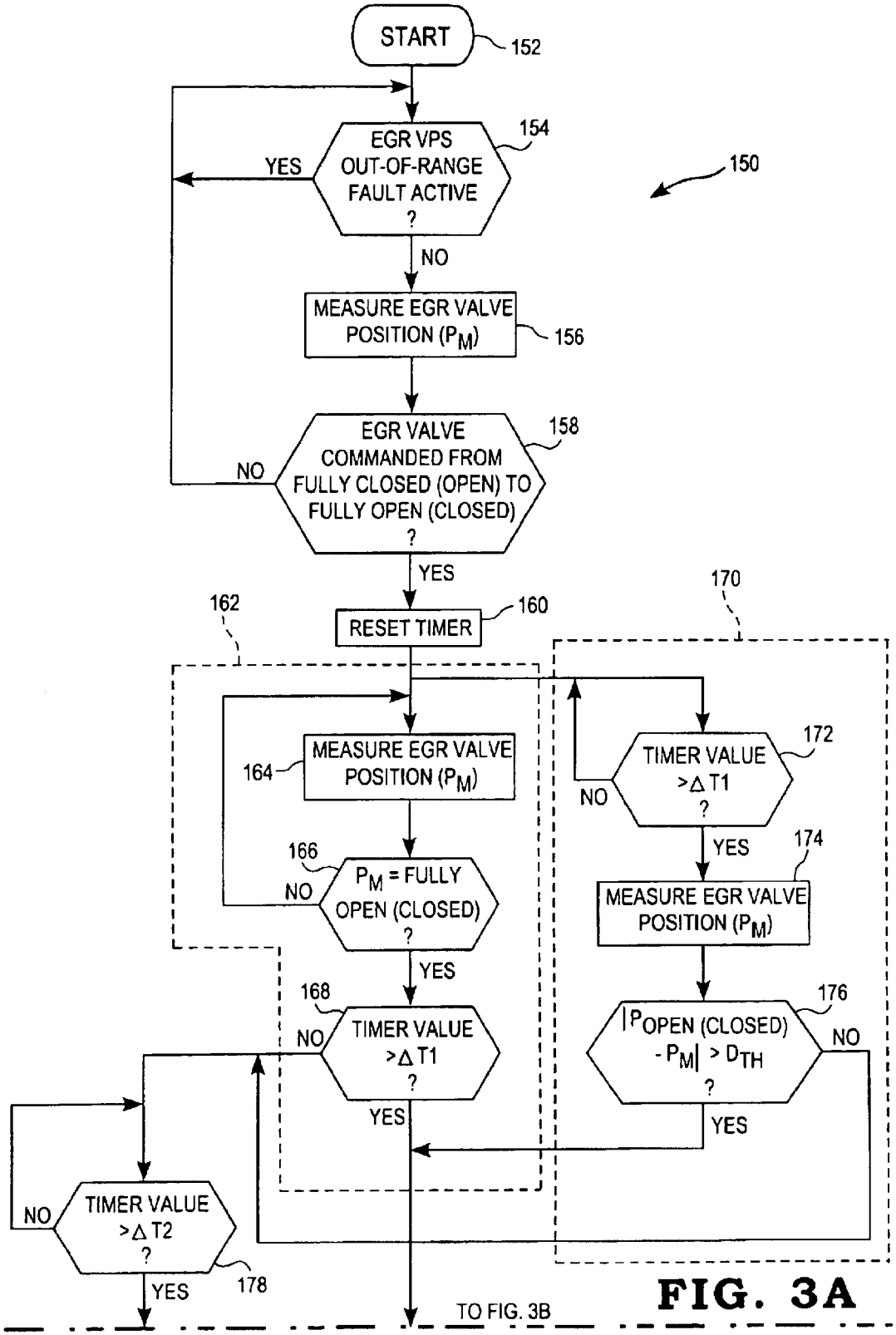
FIGS. 3A and 3B comprise a flowchart illustrating one preferred embodiment of a software algorithm for diagnosing in and out of range EGR valve sensor related failures, in accordance with the present invention.
Figure 3B:
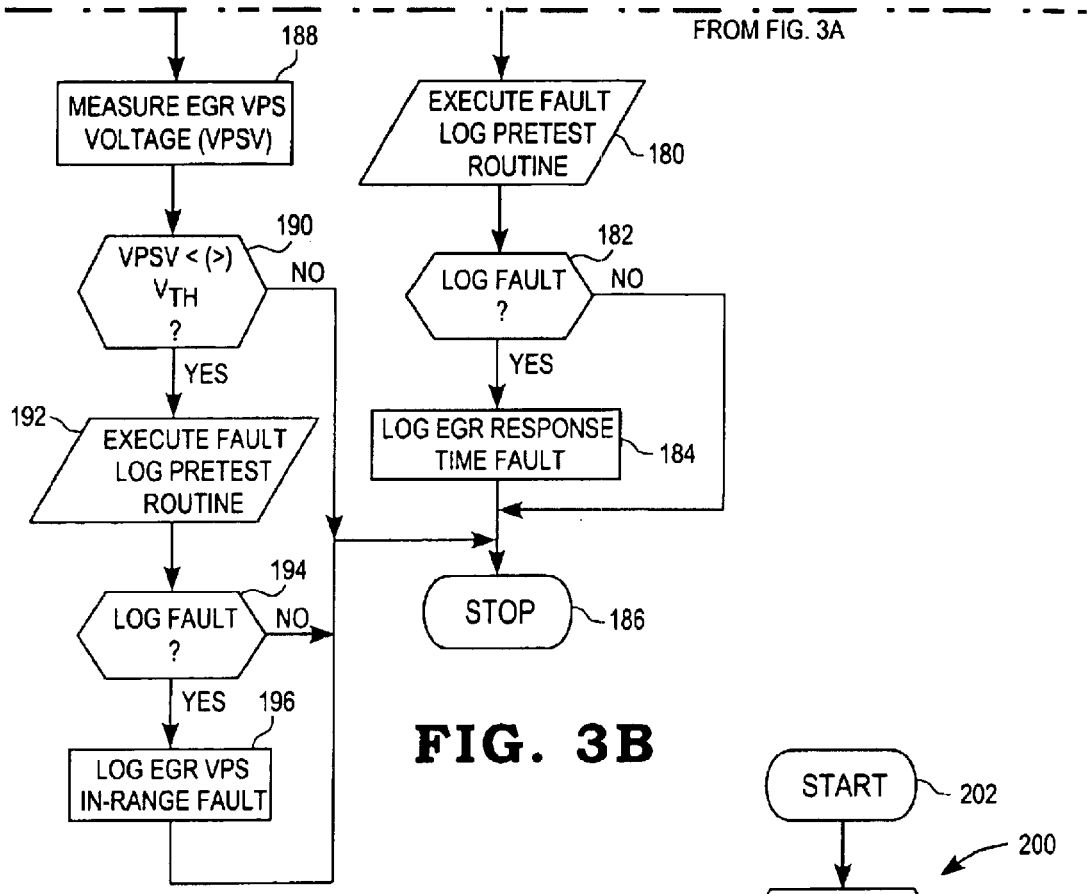

In addition to valve functionality, it is important to determine whether the response time of EGR valve 26 opens and closes at expected opening and closing rates. Referring to FIGS. 3A and 3B, a flowchart is shown illustrating one preferred embodiment of a software algorithm 150 for monitoring EGR valve opening and closing rates to determine whether out-of-range EGR valve sensor failures exist, as well as for diagnosing in-range EGR valve sensor signal functionality. Algorithm 150 is preferably stored within the EGR valve diagnostics block 38 of FIG. 1, and is executable by controller 30 in a manner known in the art. Algorithm 150 begins at step 152, and at step 154 controller 30 is operable to determine whether an EGR valve position sensor out-of-range fault is currently active. If so, algorithm execution loops back to step 154. If, however, controller 30 determines at step 154 that an EGR valve position sensor out-of-range fault is not currently active, algorithm execution advances to step 156 where controller 30 is operable to measure a current EGR valve position ($P_M$). Preferably, controller 30 is operable to execute step 156 by monitoring the actuator position signal (AP) produced by valve actuator mechanism 36. Thereafter at step 158, controller 30 is operable to command the EGR valve 26 (via EGR valve actuator command signal VAC) from either a fully closed to a fully open position, or alternatively from a fully open to a fully closed position. Thereafter at step 160, controller 30 is operable to reset a timer.

In accordance with one embodiment of the present invention, algorithm 150 advances from step 160 to step 162 wherein step 162 includes steps 164–168. At step 164, controller 30 is operable to measure a current position ($P_M$) of EGR valve 26, preferably by monitoring the actuator position signal (AP) produced by valve actuator mechanism 36. Thereafter at step 166, controller 30 is operable to determine whether the current value of $P_M$ corresponds to a fully open, or alternatively a fully closed, position. If not, algorithm execution loops back to step 164. If, however, controller 30 determines at step 166 that the current value of $P_M$ corresponds to a fully open, or alternatively a fully closed, position, algorithm execution advances to step 168 where controller 30 is operable to compare the elapsed time value of the timer with a predefined time value ΔT1. If the elapsed time value at step 168 is less than or equal to ΔT1, algorithm execution advances to step 178. If, however, controller 30 determines at step 168 that the elapsed time value is greater than ΔT1, algorithm execution advances to step 180.

In an alternative embodiment of the present invention, algorithm execution advances from step 160 to step 170, wherein step 170 includes steps 172–176. At step 172, controller 30 is operable to compare the elapsed time value with the predefined time value ΔT1. If the elapsed time value is less than or equal to ΔT1, algorithm execution loops back to step 172. If, however, controller 30 determines at step 172 that the elapsed time value is greater than ΔT1, algorithm execution advances to step 174 where controller 30 is operable to measure a current position ($P_M$) of the EGR valve 26, preferably by monitoring the actuator position signal (AP) produced by valve actuator mechanism 36. From step 174, algorithm execution advances to step 176 where controller 30 is operable to determine a difference between a predefined valve open position $P_{OPEN}$, or alternatively predefined valve closed position $P_{CLOSED}$, and the measured valve position $P_M$. If the difference is less than or equal to a predefined distance $D_{TH}$, algorithm execution advances to step 178. If, however, controller 30 determines at step 176 that the position difference is greater than the distance threshold $D_{TH}$, algorithm execution advances to step 180.

Figure 4:
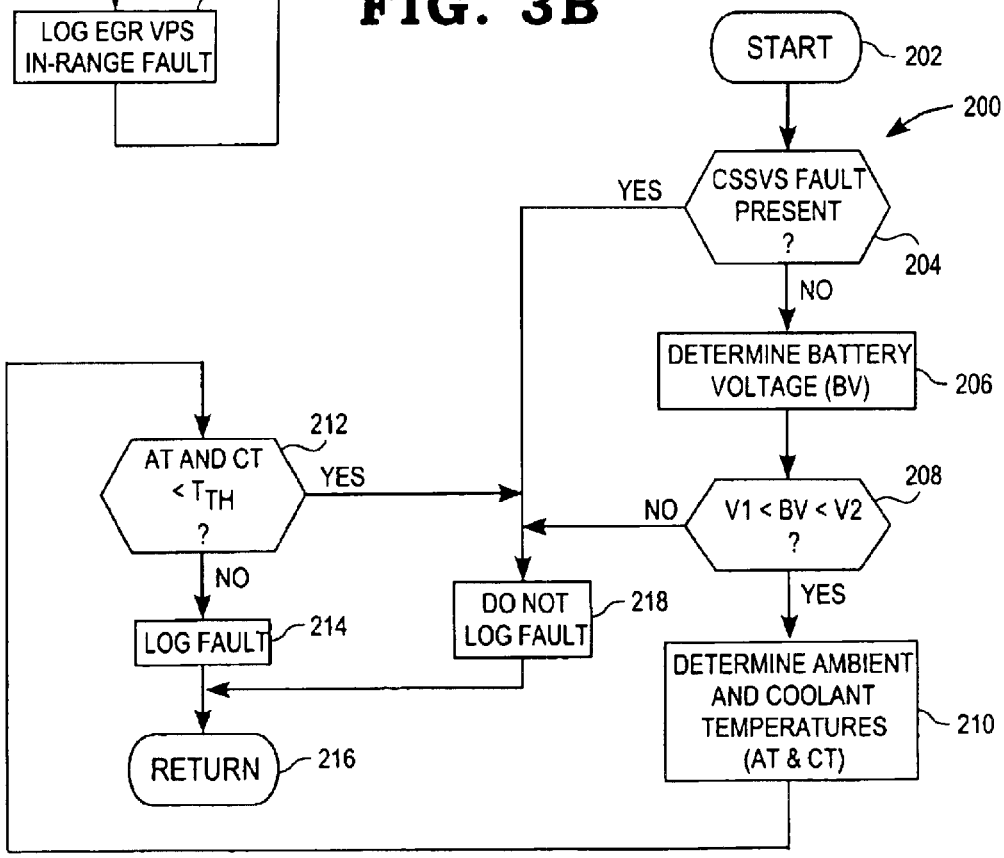
FIG. 4 is a flowchart illustrating one preferred embodiment of a software algorithm for executing the fault log pretest required by the algorithms of FIGS. 2A–2B and 3A–3B.

Regardless of whether algorithm 150 executes step 162 or step 170, both advance to step 180 where controller 30 is operable to execute the fault log pretest routine of FIG. 4. Thereafter at step 182, controller 30 is operable to determine whether a fault should be logged. If so, algorithm execution advances to step 184 where controller 30 is operable to log an EGR valve response time fault. Execution advances from step 184, and from the "no" branch of step 182, to step 186 where execution of algorithm 184, 150 is stopped.

From the "no" branch of steps 168 and step 176, algorithm execution advances to step 178 where controller 30 is operable to compare the value of the timer with a second predefined time value ΔT2. If the timer value is less than or equal to ΔT2 at step 178, algorithm execution loops back to step 178. If, on the other hand, controller 30 determines that the timer value is greater than ΔT2 at step 178, algorithm execution advances to step 188 where controller 30 is operable to measure the EGR valve position sensor voltage (VPSV). Preferably, the actuator position signal (AP) is produced by valve actuator mechanism 36 in units of voltage, and controller 30 is operable to execute step 188 by monitoring the actuator position signal (AP). In any case, algorithm execution advances from step 188 to step 190 where controller 30 is operable to compare the valve position sensor voltage (VPSV) with a voltage threshold $V_{TH}$. If, at step 190, controller 30 determines that VPSV is less than $V_{TH}$ in the case of a commanded valve opening event from a fully closed to a fully open position, or alternatively greater than $V_{TH}$ in the case of a commanded valve closing event from a fully open to a fully closed position, algorithm execution advances to step 186. If, on the other hand, controller 30 determines at step 190 that VPSV is less than $V_{TH}$ (or alternatively is greater than $V_{TH}$) algorithm execution advances to step 192 where controller 30 is operable to execute the fault log pretest routine of FIG. 4. Thereafter at step 194, controller 30 is operable to determine whether a fault should be logged, and if so to log at step 196 an EGR valve position sensor in-range fault. From step 196, and from the "no" branch of step 194, algorithm execution advances to step 186.

Algorithm 150 is operable to command the EGR valve 26 from either a fully closed position to a fully opened position, or from a fully open position to a fully closed position, and to determine a response time therefor. In so doing, algorithm 150 is operable in one embodiment to monitor the position of EGR valve 26 and to measure an elapsed time between valve fully open and valve fully closed, or valve fully closed and fully open, conditions. Alternatively, algorithm 150 is operable to monitor the response time of EGR valve 26 by first allowing a predefined time to elapse and then measuring a difference between EGR valve position and an expected EGR valve position. In either case, controller 30 is operable to log an out-of-range failure if the response time is greater than expected. In typical applications, the response time for EGR valve 26 to move from a fully closed to a fully open position is greater than response time requirement to fully close EGR valve 26 from a fully open position.

Algorithm 150 is further operable to detect EGR valve position in-range failures by monitoring the valve position sensor voltage when the EGR valve 26 transitions from either a fully closed to a fully open position, or from a fully open to a fully closed position. In one embodiment, two diagnostic thresholds are defined: 1 volt and 3.2 volts. When the EGR valve 26 is commanded from a fully open position to a fully closed position, the sensor reading should be less than 1 volt, and should be larger than 3.2 volts when commanded from a fully closed to a fully open position. Algorithm 150 provides in each case a settling time $\Delta T2$ for the sensor voltage to stabilize. If the EGR valve 26 is commanded from the open to the fully closed position and a sensor voltage of greater than 1 volt is detected after the predefined settling time period, controller 30 is operable to log an in-range "high" fault. If the EGR valve 26 is commanded from the closed to the fully open position, and a sensor voltage of less than 3.2 volts is detected after the predefined settling time, controller 30 is operable to log an in-range "low" error. Those skilled in the art will recognize that other voltage thresholds may be used, wherein such other thresholds are intended to fall within the scope of the present invention.

Referring now to FIG. 4, one preferred embodiment of a software algorithm 200, for executing the fault log pretest routine of algorithms 100 and 150, is shown. Algorithm 200 begins at step 202 and at step 204 controller 30 is operable to determine whether a charging system sensor voltage supply fault is currently active, preferably by monitoring the charging system voltage fault value (CSVF) of FIG. 1. If such a fault is present, algorithm execution advances to step 218. If not, algorithm execution advances to step 206 where controller 30 is operable to determine battery voltage (BV), preferably by monitoring signal path 46. Thereafter at step 208, controller 30 is operable to determine whether the battery voltage (BV) is between voltage ranges defined by V1 and V2. If controller 30 determines at step 208 that the battery voltage (BV) is outside of the range defined by V1 and V2, algorithm execution advances to step 218. Otherwise, algorithm execution advances to step 210 where controller 30 is operable to determine ambient and coolant temperatures (AT and CT), preferably by monitoring the ambient temperature on signal path 42 and the coolant temperature signal on signal path 52. Thereafter at step 212, controller 30 is operable to determine whether the ambient temperature signal (AT) and the coolant temperature signal (CT) are both less than a temperature threshold $T_{TH}$. If so, algorithm execution advances to step 218 where controller 30 sets a "do not log fault" instruction. If, on the other hand, controller 30 determines at step 212 that the ambient temperature (AT) and the coolant temperature (CT) are not both less than $T_{TH}$, algorithm execution advances to step 214 where controller 30 produces a "log fault" instruction. From steps 214 or 218, algorithm execution advances to step 216 where the fault log pretest routine 200 of FIG. 4 is returned to its calling routine.

It should now be evident from FIG. 4 that any fault conditions detected by algorithm 100 of FIGS. 2A–2B or algorithm 150 of FIGS. 3A–3B will not be logged if a charging system sensor voltage supply fault is currently active, battery voltage is out of range, or the ambient and coolant temperatures are below a predefined temperature threshold.

While the foregoing algorithms described in FIGS. 2A–4 are operable to detect certain EGR valve-related failures, they are generally not operable to isolate particular failure modes associated with the EGR valve control system. For example, when a valve position in-range fault occurs, algorithm 150 is not operable to determine a cause (e.g., sticking valve, failed position sensor, etc.) of the fault. In accordance with the present invention, the EGR valve control system failure isolation block 54 of controller 30 is operable to isolate different failure modes to determine whether any such failures or faults are due to actuator controller failures, valve sticking failures, position sensor failures or current sensor failures.

Figure 5:
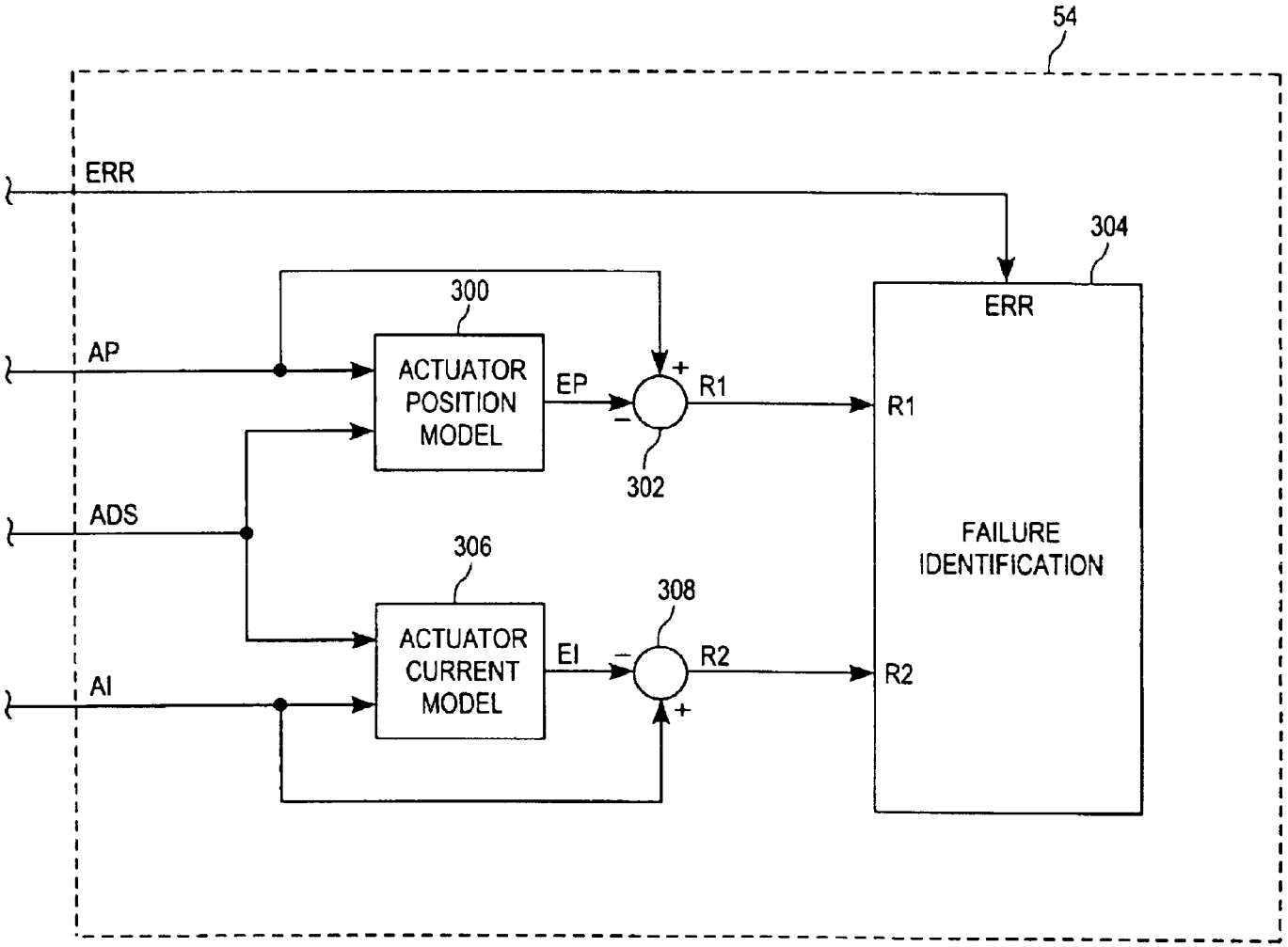
FIG. 5 is a diagrammatic illustration of one preferred embodiment of the EGR valve control system failure isolation block of FIG. 1, in accordance with the present invention.

Referring now to FIG. 5, one preferred embodiment of the EGR valve control system failure isolation block 54 of FIG. 1 is shown. Block 54 includes a first actuator position model 300 receiving the actuator position signal (AP) from the valve actuator mechanism 36 and the actuator drive signal (ADS) produced by the valve controller block 34. The actuator position model 300 is operable to process the foregoing input signals and produce an estimated valve position signal (EP) as a function thereof. The estimated position signal (EP) is provided to a subtraction input of a summing node 302 having an addition input receiving the actuator position signal (AP) produced by valve actuator mechanism 36. An output of summing node 302 defines a first residual value R1 as a difference between the actuator position signal (AP) and the estimated position signal (EP).

Block 54 further includes a second actuator current model 308 having a first input receiving the actuator drive signal (ADS) produced by valve controller block 34, and a second input receiving the actuator current value (Al) produced by valve actuator mechanism 36. Actuator current model 306 is operable to process the foregoing input signals and produce an estimated current value (El) as a function thereof. A second summing node 308 has a subtraction input receiving the estimated current value (El) and an addition input receiving the actuator current value (Al) produced by valve actuator mechanism 36. An output of summation node 308 produces a second residual value R2 as a difference between the actuator current value (Al) and the estimated current value (El). Block 54 further includes a failure identification block 304 having a first input receiving the error signal (ERR) produced at the output of summing node 32, a second input (R1) receiving the first residual value R1 from the output of summing node 302, and a third input (R2) receiving the second residual value from the output of summing node 308.

In the algorithm illustrated in FIG. 5, actuator position models 300 and 308 preferably correspond to Kalman filters configured to estimate actuator position and actuator armature current, respectively. The Kalman filters are preferably designed based on a known set of conventional motor equations representing an EGR valve model wherein the EGR valve position estimation value (EP) is derived based on the equations:

$$\frac{d\bar{i}}{dt} = -\frac{ra}{La}\bar{i} - \frac{Ke}{La}\varpi + \frac{ADS}{La} - K_{11}R1(t)$$

$$\frac{d\varpi}{dt} = \frac{Ke}{Ja}f(\bar{i}) - \frac{Bm}{Ja}\varpi - \frac{Bs}{Ja}\mathrm{sign}(\varpi) - \frac{\mathrm{L}Krs}{grJa}\bar{p} - \frac{\mathrm{L}}{Ja*gr}Ps2a*Va*\Delta P - \frac{\mathrm{L}}{Ja*gr}vspl - K_{12}R1(t)$$

$$\frac{d\bar{p}}{dt} = \frac{gr}{1000\ \mathrm{L}}\varpi + K_{13}R1(t),$$

wherein the position residual is defined as $R1(t)=p(t)-\bar{p}(t)$. The parameters $\bar{i}$, $\bar{\omega}$, and $\bar{p}$ are the estimated motor armature current, speed and valve lift position, respectively. $\Delta P$ is the differential pressure across the EGR valve 26 and is very small after the EGR valve 26 is open, and may be therefore typically be neglected.

The armature current estimation value (El) is preferably estimated in accordance with the equations:

$$\frac{d\bar{i}}{dt} = -\frac{ra}{La}\bar{i} - \frac{Ke}{La}\varpi + \frac{ADS}{La} - K2_1R2(t)$$

$$\frac{d\varpi}{dt} = \frac{Ke}{Ja}f(\bar{i}) - \frac{Bm}{Ja}\varpi - \frac{Bs}{Ja}\mathrm{sign}(\varpi) - \frac{\mathrm{L}Krs}{grJa}\bar{p} - \frac{\mathrm{L}}{Ja*gr}Ps2a*Va*\Delta P - \frac{\mathrm{L}}{Ja*gr}vspl - K_{22}R2(t)$$

$$\frac{d\bar{p}}{dt} = \varpi\frac{gr}{1000\ \mathrm{L}} + K_{23}R2(t),$$

wherein the current residual is defined by the equation $R2(t)=i(t)-\bar{i}(t)$. $K_{11}$, $K_{12}$, $K_{13}$, $K_{21}$, $K_{22}$, and $K_{23}$ are Kalman filter gains, which can be obtained by solving two known Riccati equations.

It is to be understood that while the actuator current models 306 and 308 of FIG. 5 have been described herein as preferably comprising Kalman-based filters, those skilled in the art will recognize that other known actuator position and actuator current models may be used to estimate actuator position and actuator current, wherein such values may be used to generate residual values R1 and R2.

Figure 6:
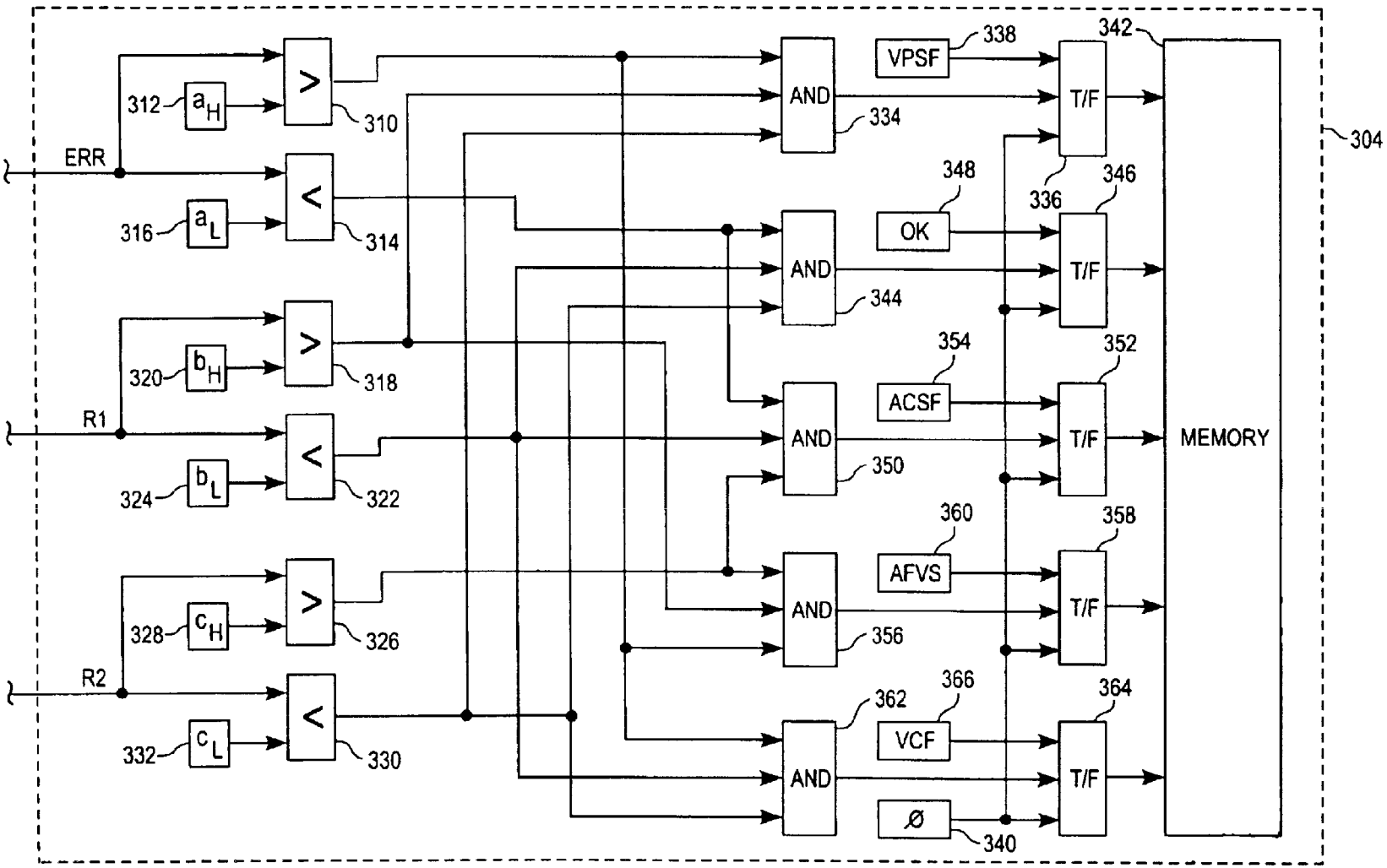
FIG. 6 is a diagrammatic illustration of one preferred embodiment of the failure identification block of FIG. 5, in accordance with the present invention.

Referring now to FIG. 6, one preferred embodiment of the failure identification block 304 of FIG. 5, in accordance with the present invention, is shown. Block 304 includes a first arithmetic operator block 310 having a first input receiving the error signal (ERR) produced by summing node 32 (FIG. 1) and a second input receiving a first high threshold value $a_H$ from block 312. The arithmetic operator block 310 is preferably a "greater than" operator, wherein block 310 produces a "true" signal if ERR is greater than $a_H$, and otherwise produces a "false" signal. Block 304 includes a second arithmetic operator block 314 having a first input receiving the error signal ERR and a second input receiving a low threshold value $a_L$ from block 316. The arithmetic operator of block 314 is preferably a "less than" operator such that block 314 produces a "true" signal if ERR is less than $a_L$, and otherwise produces a "false" value.

Block 304 includes identical arithmetic operator blocks 318 and 322 operable to compare the first residual value R1 to high and low threshold values $b_H$ and $b_L$ produced by blocks 320 and 324, respectively. Another set of identical arithmetic operator blocks 326 and 330 are operable to compare the second residual value R2 to upper and lower threshold values $c_H$ and $c_L$ produced by blocks 328 and 332, respectively. Arithmetic operator blocks 318–330 are configured to produce "true" and "false" values based on the respective residual values R1 and R2 as compared with their respective high and low threshold values as described hereinabove with respect to arithmetic operator blocks 310 and 314.

Block 304 further includes a first AND block 334 having a first input connected to the output of arithmetic operator block 310, a second input connected to the output of arithmetic operator block 318 and a third input connected to the output of arithmetic operator block 330. The output of AND block 334 is provided to one input of a true/false block 336 having a second input receiving a valve position sensor failure value (VPSF) from block 338 and a third input receiving a null value from block 340. An output of true/false block 336 is connected to a memory unit 342. If the error value (ERR) is greater than $a_H$, R1 is greater than $b_H$ and R2 is less than $c_L$, true/false block 336 is operable to provide the valve position sensor failure value (VPSF) to the memory unit 342 to thereby log a valve position sensor fault or failure therein. Any other combination of inputs to AND block 334 will cause true/false block 336 to log nothing into memory unit 342.

Block 304 includes a second AND block 344 having a first input connected to the output of arithmetic operator block 314, a second input connected to the output of arithmetic operator block 322 and a third input connected to the output of arithmetic operator block 330. An output of AND block 344 is connected to a first input of true/false block 346 having a second input receiving an OK value from block 348 and a third input receiving the null value from block 340. An output of true/false block 346 is connected to memory unit 342. If the error value (ERR) is less than $a_L$, the first residual value (R1) is less than $b_L$ and the second residual value (R2) is less than $c_L$, true/false block 346 is operable to provide the OK value to memory unit 342 to thereby log an indication that the EGR valve control system is working properly. Any other combination of inputs at AND block 342 will cause the true/false block 346 to log nothing.

Block 304 further includes a third AND block 350 having a first input connected to the output of arithmetic operator block 314, a second input connected to the output of arithmetic operator block 322 and a third input connected to the output of arithmetic operator block 326. An output of AND block 350 is connected to a first input of a true/false block 352 having a second input receiving an armature current sensor failure value (ACFS) from block 354 and a third input receiving the null value from block 340. The output of true/false block 352 is connected to the memory unit 342. If the error value (ERR) is less than $a_L$, the first residual value (R1) is less than $b_L$ and the second residual value (R2) is greater than $c_H$, true/false block 352 is operable to provide the armature current sensor failure value (ACFS) to memory unit 342 to thereby log an armature current sensor failure therein. Any other combination of inputs at AND block 350 will cause true/false block 352 to log nothing within memory 342.

Block 304 further includes another AND block 356 having a first input connected to the output of arithmetic operator block 326, a second input connected to the output of arithmetic operator block 318 and a third input connected to the output of arithmetic operator block 310. An output of AND block 356 is connected to a first input of a true/false block 358 having a second input receiving an actuator failure/valve sticking value (AFVS) from block 360 and a third input receiving the null value from block 340. The output of true/false block 358 is connected to memory unit 342. If the error value (ERR) is greater than $a_H$, the first residual value (R1) is greater than $b_H$ and the second residual value (R2) is greater than $c_H$, true/false block 358 is operable to provide the actuator failure/valve sticking value (AFVS) to memory unit 342 to thereby log an actuator failure or valve sticking failure indicator therein.

Block 304 further includes a fifth AND block 362 having a first input connected to the output of arithmetic operator block 310, a second input connected to the input of arithmetic operator block 322 and a third input connected to the output of arithmetic operator block 330. An output of AND block 362 is connected to a first input of true/false block 364 having a second input receiving a valve controller failure value (VCF) from block 366 and a third input receiving the null value from block 340. The output of true/false block 364 is connected to memory unit 342. If the error value (ERR) is greater than $a_H$, the first residual value (R1) is less than $b_L$ and the second residual value (R2) is less than $c_L$, true/false block 364 is operable to provide the valve controller failure value (VCF) of block 366 to memory block 342, to thereby log a valve controller failure therein. It is to be understood that the threshold values $a_H$, $a_L$, $b_H$, $b_L$, $c_H$ and $c_L$ are calibratable values, and will generally be dictated by the physical configuration of the EGR valve 26 and the valve actuator mechanism 36.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected. For example, while the invention has been shown and described hereinabove as applicable to an EGR valve, those skilled in the art will recognize that the concepts of the present invention may be equally applied to other air handling system control mechanisms including any one, or combination of, an electronically variable geometry turbocharger, an electronically controllable exhaust gas wastegate and/or an electronically controllable exhaust throttle.

What is claimed is:

1. A system for diagnosing EGR valve-related failure conditions, comprising:

an EGR valve having a valve inlet in fluid communications with an exhaust manifold of an internal combustion engine and a valve outlet in fluid communications with an intake manifold of said engine, said EGR valve responsive to a valve command to control exhaust gas flow therethrough;

an EGR valve position sensor producing an EGR valve position signal indicative of EGR valve position; and an engine controller producing said valve command, said engine controller responsive to said valve position signal to determine a final valve position after a time delay following said valve command commanding said EGR valve from one of a fully closed and a fully open position to one of a fully open and a fully closed position, said engine controller logging an EGR valve response time fault if a difference between said final valve position and an expected valve position is greater than a position threshold.

2. The system of claim 1 wherein said controller is configured to measure a voltage associated with said EGR valve sensor if said difference is less than said position threshold, said controller logging an EGR valve position sensor in-range fault condition if said voltage is one of greater than a fully open sensor voltage threshold and less than a fully closed sensor voltage threshold.

3. The system of claim 2 wherein said controller is configured to log an EGR valve position sensor in-range high fault if said voltage is greater than said fully closed voltage threshold when said valve command corresponds to commanding said EGR valve from said fully open to said fully closed position.

4. The system of claim 3 wherein said controller is configured to log an EGR valve position sensor in-range low fault if said voltage is less than said fully open voltage threshold when said valve command corresponds to commanding said EGR valve from said fully closed to said fully open position.

5. The system of claim 1 further including a vehicle battery connected to said EGR valve position sensor, said controller logging said fault only if a voltage of said battery is within a predefined voltage range.

6. The system of claim 1 further including:

means for determining an operating temperature of said engine and producing an engine temperature signal corresponding thereto; and means for determining ambient temperature and producing an ambient temperature signal corresponding thereto, said controller logging said fault only if said engine temperature and said ambient temperature are both below a temperature threshold.

7. A method of diagnosing EGR valve-related failure conditions comprising the steps of:

monitoring a valve position of an EGR valve disposed between an exhaust manifold and an intake manifold of an internal combustion engine;

monitoring an EGR valve command;

determining a final valve position after a time delay following said valve command corresponding to commanding said EGR valve from one of a fully open and a fully closed position to one of a fully closed to a fully open position;

logging an EGR valve response time fault if a difference between said final valve position and an expected valve position is greater than a position threshold.

8. The method of claim 7 wherein said response time when said valve command corresponds to commanding said EGR valve from said fully open position to said fully closed position is less than said response time when said valve command corresponds to commanding said EGR valve from said fully closed position to said fully open position.

9. The method of claim 7 further including the steps of:

measuring a voltage associated with a sensor sensing said valve position if said response time is below a response time limit; and logging an EGR valve position sensor in-range fault condition if said voltage is one of greater than a fully open sensor voltage threshold and less than a fully closed sensor voltage threshold.

10. The method of claim 9 wherein the step of logging an EGR valve position sensor in-range fault condition includes logging an EGR valve position sensor in-range high fault if said voltage is greater than said fully closed voltage threshold when said valve command corresponds to commanding said EGR valve from said fully open to said fully closed position.

11. The method of claim 9 wherein the step of logging an EGR valve position sensor in-range fault condition includes logging an EGR valve position sensor in-range low fault if said voltage is less than said fully open voltage threshold when said valve command corresponds to commanding said EGR valve from said fully closed to said fully open position.

* * * * *